US010460867B2

(12) United States Patent
Yang

(10) Patent No.: US 10,460,867 B2
(45) Date of Patent: Oct. 29, 2019

(54) UPRIGHT COMPOSITE COMMON MODE COIL ASSEMBLY

(71) Applicant: YUJING TECHNOLOGY CO., LTD., Taoyuan (TW)

(72) Inventor: Sen-Tai Yang, Taoyuan (TW)

(73) Assignee: Yujing Technology Co., Ltd., Taoyuan (TW)

( * ) Notice: Subject to any disclaimer, the term of this patent is extended or adjusted under 35 U.S.C. 154(b) by 168 days.

(21) Appl. No.: 15/651,076

(22) Filed: Jul. 17, 2017

(65) Prior Publication Data

US 2018/0174742 A1 Jun. 21, 2018

(30) Foreign Application Priority Data

Dec. 15, 2016 (TW) ..... 105141588 A

(51) Int. Cl.

| | |
|---|---|
| ***H01F 27/28*** | (2006.01) |
| ***H01F 27/30*** | (2006.01) |
| ***H01F 27/06*** | (2006.01) |
| ***H01F 27/26*** | (2006.01) |
| ***H01F 37/00*** | (2006.01) |

(Continued)

(52) U.S. Cl.

CPC ..... *H01F 27/306* (2013.01); *H01F 5/04* (2013.01); *H01F 27/02* (2013.01); *H01F 27/06* (2013.01); *H01F 27/266* (2013.01); *H01F 27/325* (2013.01); *H01F 37/00* (2013.01); *H01F 41/00* (2013.01); *H01F 2005/046* (2013.01); *H01F 2017/0093* (2013.01); *H01F 2027/065* (2013.01)

(58) Field of Classification Search

USPC ..... 336/185, 199, 207, 224

See application file for complete search history.

(56) References Cited

U.S. PATENT DOCUMENTS

2011/0115595 A1* 5/2011 Tseng ..... H01F 27/29 336/192
2013/0154782 A1* 6/2013 Won ..... H01F 5/02 336/192
2014/0084790 A1* 3/2014 Won ..... H05K 9/00 315/85

* cited by examiner

*Primary Examiner* — Elvin G Enad
*Assistant Examiner* — Kazi S Hossain
(74) *Attorney, Agent, or Firm* — Alan D. Kamrath; Mayer & Williams PC

(57) ABSTRACT

An upright composite common mode coil assembly includes a coil carrier and a seat. The coil carries includes two bobbins with a plurality of coils wounded thereon. The seat includes a base, a bottom portion, a top portion and a separating portion. The base has a back plate on a surface thereof, hollow portions formed at an upper position and a lower position thereof, a wire slot and an indentation are provided at either side of the back plate. The bottom portion and the top portion extend vertically from two sides of the base. A recessed portion is formed at each of the corners of the bottom portion, and a pin is inserted into each of the recessed portions. The top portion has a flat top face. The separating portion extends from another surface of the base and tapered to form a curved surface, and form two receiving slots with the top portion and the bottom portion, respectively. Each of the bobbins of the coil carrier is received in one of the receiving slots of the seat, and wires of a group of the coils are guided into some of the recessed portions through the wire slots and the indentations, and wires of another group of the coils are guided into the other recessed portions through the notches, so that the wires of the coils do not protrude out of the seat and are neatly soldered on the pins.

6 Claims, 4 Drawing Sheets

(51) Int. Cl.

| | |
|---|---|
| ***H01F 5/04*** | (2006.01) |
| ***H01F 27/02*** | (2006.01) |
| ***H01F 27/32*** | (2006.01) |
| *H01F 17/00* | (2006.01) |
| *H01F 41/00* | (2006.01) |

UPRIGHT COMPOSITE COMMON MODE COIL ASSEMBLY

BACKGROUND OF THE INVENTION

1. Field of the Invention

The invention relates to an upright composite common mode coil assembly that facilitates automatic discharging on a production line, reduces the layout area of a circuit board, and facilitates stacking of a plurality of these assemblies; the assembly also has no protruding wires.

2. Description of the Prior Art

Conventionally, a transformer having a common mode choke and a differential mode choke, in operation, receives an AC voltage source, which is passed through the common mode choke and the differential mode choke to a rectifier, and a DC voltage source is outputted. The common mode choke and the differential choke are used to cancel common mode noise and differential mode noise. A reference is made here to a TW Patent Publication No. I341540, titled "Composite Common Mode Coil", which includes: a base, a coil carrier, and an iron core. The base has two receiving slots and a separating slot located between the two receiving slots. The coil carrier is provided with two bobbins, each having a plurality of coils wound around the outer circumference of the bobbin, and the two bobbins are respectively disposed in the two receiving slots. The iron core has two opposite sides and is positioned in the separating slot with their sides abut against the bobbins. A current is passed through the plurality of coils in each bobbin, resulting in a leakage inductance formed in the bobbin carrier. The magnitude of the leakage inductance can be changed by adjusting the surface area of the sides. However, the coils in this publication are arranged side by side horizontally, so they will occupy a large area on a circuit board when they are actually connected to the circuit board, and as a result of this, the area of the circuit board cannot effectively reduced. Meanwhile, when the coils are in operation, they will produce heat, but due to the horizontal arrangement of the coils, the coil are in proximity to the circuit board, which will not allow air to circulate easily. The poor heat dissipation leads to higher temperature and lower efficiency.

In order to address the issue associated with large-sized transformers, another type of transformer has been proposed, referring to, for example, a TW Patent Publication No. M479500, titled "Vertical Surface-Mounted Transformer", which includes an iron core, at least two groups of coils, and ferromagnetic colloid surrounding the coils. The iron core includes a top portion, a base portion remote from and opposite to the top portion, and a recessed winding portion connecting the top portion and the base portion. Each of the two groups of coils respectively has at least two end contacts, and is wound around the recessed winding portion. It is characterized in that the top portion is formed with a flat surface to facilitate handling by suction, and the base portion has six bottom electrodes; each of the two end contacts from each group of coils is respectively connected to a bottom electrode. However, in this publication, although the iron core is arranged in an upright position, all the coils are horizontally arranged in parallel as viewed from a horizontal angle. The upright iron core further hinders circulation of air among the groups of coils. The poor heat dissipation leads to higher temperature and lower efficiency or even a burnt device.

In view of the above drawbacks of the conventional techniques, the inventors endeavored to find a solution and have finally come up with the present invention to address the aforementioned shortcomings.

SUMMARY OF THE INVENTION

One main objective of the present invention is to provide an upright composite common mode coil assembly that facilitates automatic discharging on a production line.

Another objective of the present invention is to provide an upright composite common mode coil assembly that reduces the layout area of a circuit board on which the assembly is provided.

Still another objective of the present invention is to provide an upright composite common mode coil assembly in which wires will not protrude out of the assembly.

Yet another objective of the present invention is to provide an upright composite common mode coil assembly that increases heat dissipation efficiency by increasing air circulation.

Yet another objective of the present invention is to provide an upright composite common mode coil assembly that facilitates stacking of a plurality of these assemblies.

In order to achieve the above objectives and efficacies, the structure employed by the present invention may include: a coil carrier having two bobbins with a plurality of coils wounded around the outer circumference of each of the bobbins; and a seat for receiving the coil carrier including: a base having a back plate on a surface thereof; a top portion and a bottom portion vertically extending from two sides of the base, respectively; and a separating portion extending from another surface of the base and tapered to form a curved surface. In the base, hollow portions are formed at an upper position and a lower position of the back plate, a wire slot is provided at either side of the back plate, and an indentation extends from one end of each of the wire slots. The bottom portion extends vertically from a side of the base, a recessed portion is formed at each of the four corners of the bottom portion, and a pin is inserted into each of the recessed portions. The top portion extends vertically from another side of the base and includes a flat top face. The separating portion extends from another surface of the base and tapered to form a curved surface, and the separating portion forming a receiving slot with the top portion and another receiving slot with the bottom portion.

As such, one bobbin of the coil carrier is received in each of the receiving slots of the seat, and wires of a group of coils are guided into some of the recessed portions through the wire slots and the indentations, and wires of another group of the coils are guided into the other recessed portions through the notches, so that the wires of the coils do not protrude out of the seat and can be neatly soldered on the pins. Meanwhile, such an assembly facilitates automatic discharging in the production line, reduces layout area of a circuit board on which the assembly is provided, and facilitates stacking of a plurality of these assemblies.

According to the above structure, the coil carrier includes two carrier plates connected through two columns, each of the bobbins includes two semi-bobbins, and the two semi-bobbins combine to surround one of the two columns.

According to the above structure, each of the bobbins of the coil carrier is received in one of the receiving slots of the seat, and the carrier plates are positioned between the top portion and the bottom portion of the seat.

According to the above structure, a surface of the back plate of the base is provided with an insertion slot.

According to the above structure, some of the recessed portions are in communication with the indentations, while the rest of the recessed portions respectively form notches with adjacent regions of the bottom portion.

According to the above structure, a wing portion extends from a side of each indentation, and a concaved portion is formed between each indentation and its corresponding wing portion.

According to the above structure, the wing portions of the indentations near the bottom portion overlie the surfaces of the wires, such that after the wires are passed into the recessed portions, the concaved portions facilitate neat soldering of the wires on the pins.

According to the above structure, insertion holes for holding the pins in place are provided in the respective recessed portions.

The objectives, efficacies and features of the present invention can be more fully understood by referring to the drawing as follows:

DETAILED DESCRIPTION OF THE PREFERRED EMBODIMENTS

Figure 1:
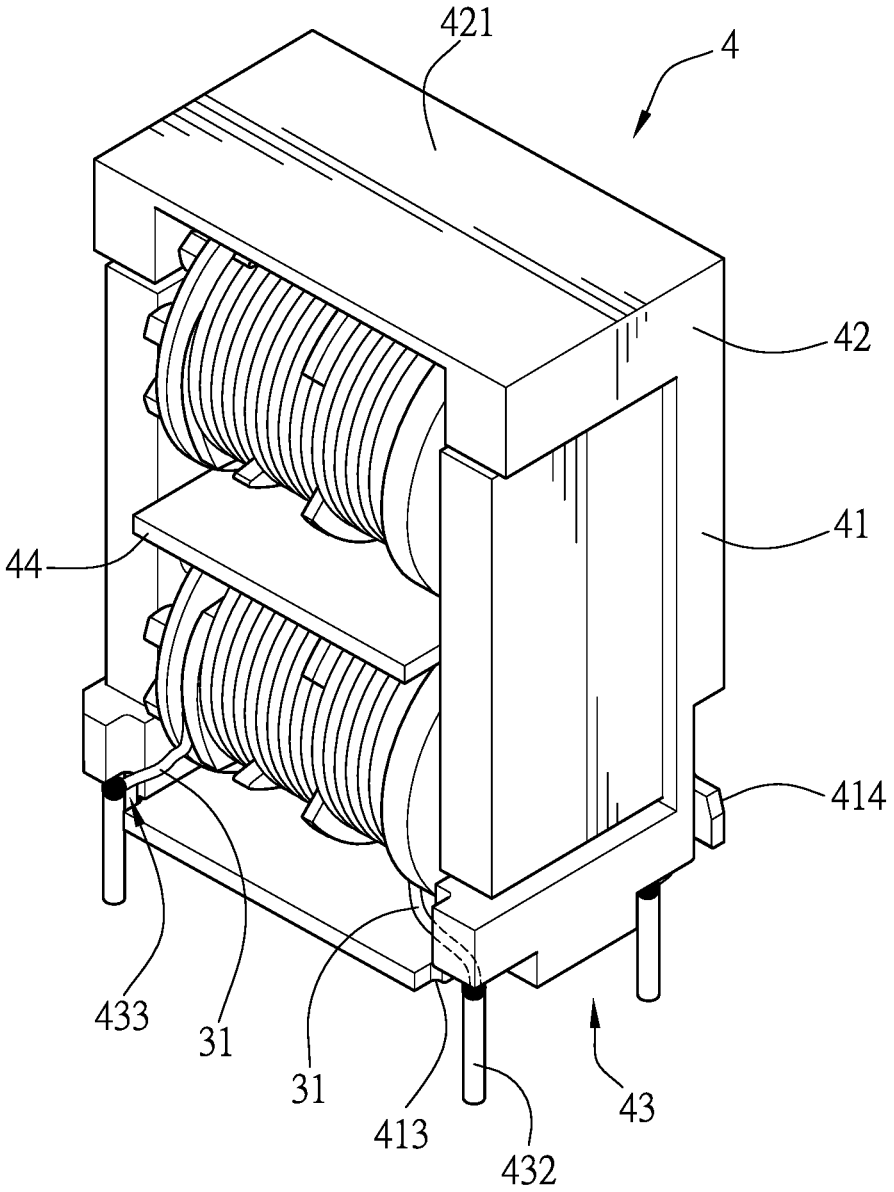
FIG. 1 is an isometric view illustrating a preferred embodiment of the present invention.
Figure 2:
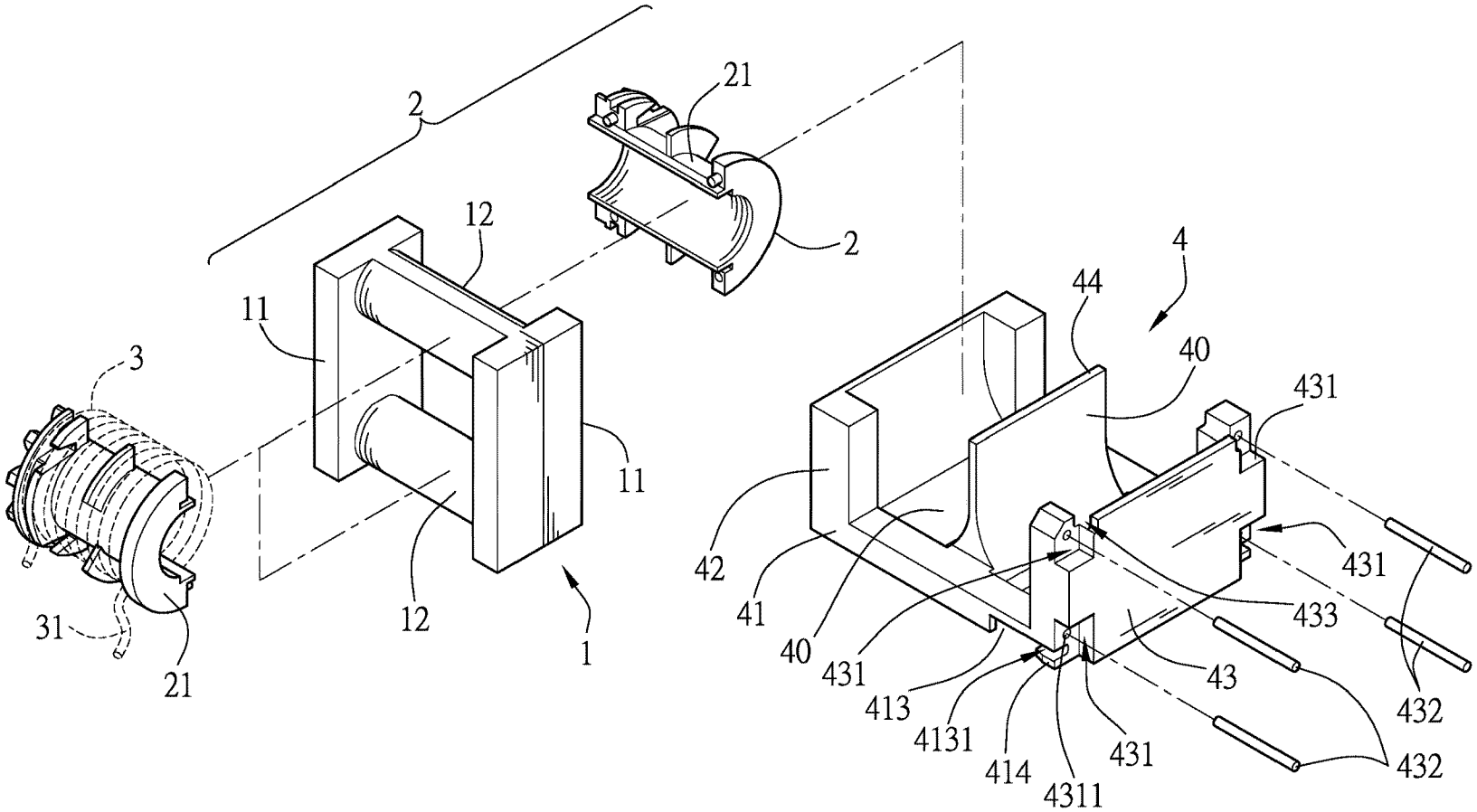
FIG. 2 is an exploded view illustrating the preferred embodiment of the present invention.
Figure 3:
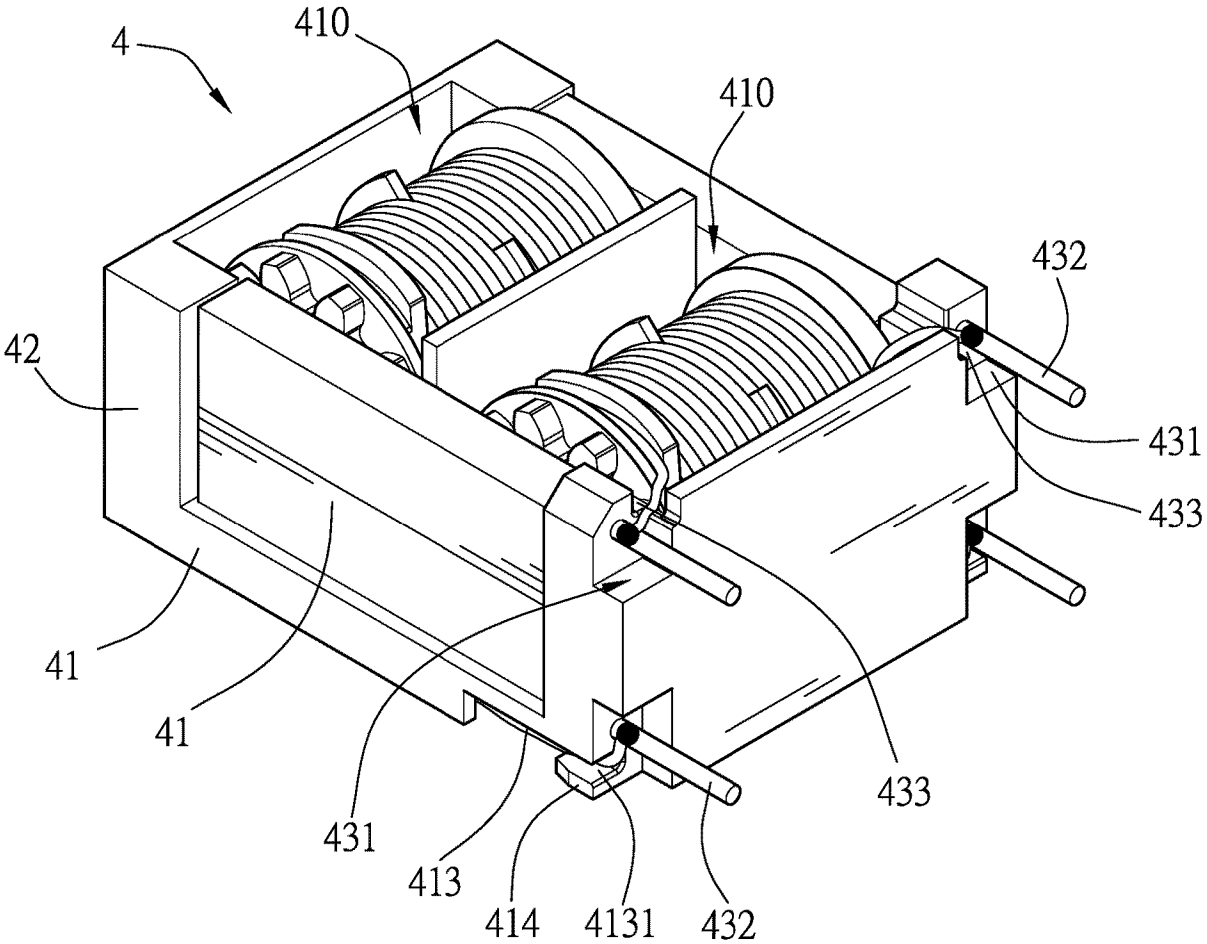
FIG. 3 is an isometric view illustrating the preferred embodiment of the present invention from another angle.
Figure 4:
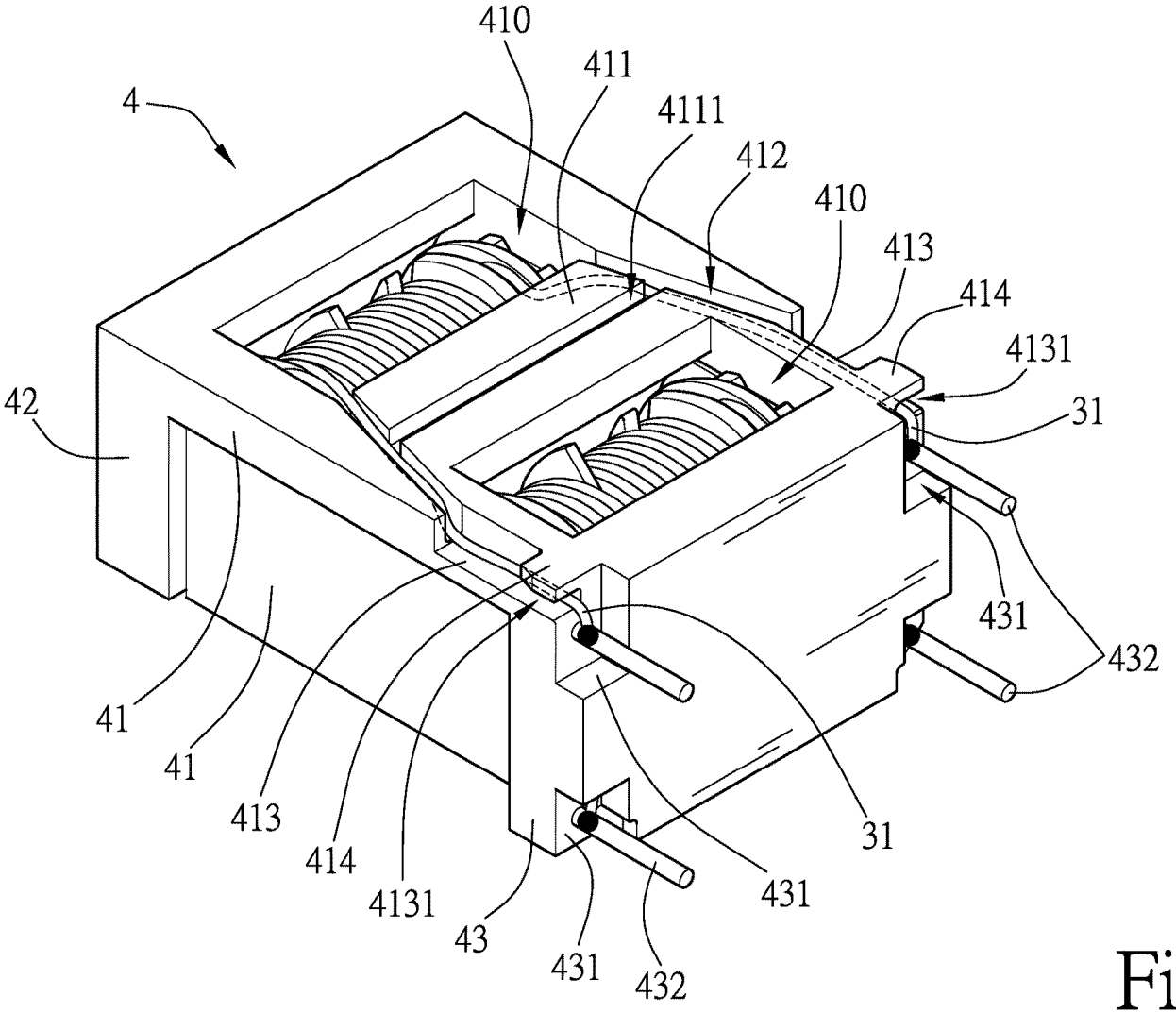
FIG. 4 is an isometric view illustrating the preferred embodiment of the present invention from yet another angle.

With reference to FIGS. 1 to 4, the structure of an upright composite common mode coil assembly in accordance with the present invention mainly includes a coil carrier 1 and a seat 4, wherein the coil carrier 1 includes two carrier plates 11 and two bobbins 2. The two carrier plates 11 are connected through two columns 12. Each of the bobbins 2 includes two semi-bobbins 21, and the two semi-bobbins 21 combine to surround one of the two columns 12. A plurality of coils 3 are wound around the outer circumference of each of the bobbins 2.

The seat 4 includes a base 41, a bottom portion 43, a top portion 42 and a separating portion 44, wherein a surface of the base 41 includes a back plate 411. Hollow portions 410 are formed at an upper position and a lower position of the back plate 411. A wire slot 412 is formed at either side of the back plate 411. An indentation 413 extends from one end of each of the wire slots 412. A wing portion 414 extends from a side of the indentation 413. A concaved portion 4131 is formed between the indentation 413 and the wing portion 414. An insert slot 4111 is formed on the surface of the back plate 411.

The bottom portion 43 extends vertically from a side of the base 41 nearer to the indentations 413. A recessed portion 431 is formed at each of the four corners of the bottom portion 43. An insertion hole 4311 is provided inside each of the recessed portion 431. The insertion hole 4311 is inserted with a pin 432. Some of the recessed portions 431 are in communication with the indentations 413. The rest of the recessed portions 431 respectively form notches 433 with adjacent regions of the bottom portion 43.

The top portion 42 extends vertically from another side of the base 41 and includes a flat top face 421.

The separating portion 44 extends from another surface of the base 41 and is tapered to form a curved surface. It forms a receiving slot 40 with the top portion 42 and another receiving slot 40 with the bottom portion 43. A side of each receiving slot 40 is in communication with one of the hollow portion 410.

One bobbin 2 of the coil carrier 1 is received in each of the receiving slots 40 of the seat 4. The carrier plates 11 are positioned between the top portion 42 and the bottom portion 43 of the seat 4. Two sides of the carrier plates 11 tightly fit with the top portion 42 and the bottom portion 43 to form a closed space with the seat 4.

It should be noted that the groups of coils are usually provided in even numbers. In this embodiment, there are two groups of coil, however, the present invention is not limited as such. After each group of the coils are wounded onto a bobbins 2, at least two wires 31 extend out for subsequent connections, as shown in the embodiment with respect to the diagrams of FIGS. 1 to 4, two groups of the coils 3 are arranged in parallel to each other, wherein the wires 31 of one group of coils 3 (the one closer to the top portion 42) pass through the wire slots 412 and the indentations 413. The wing portions 414 of the indentations 413 near the bottom portion 43 overlie the surfaces of the wires 31. After the wires 31 are passed into the recessed portions 431, the concaved portions 4131 facilitate the soldering of the wires 31 on the pins 432. The wires 31 of the other group of coils 3 (the one closer to the top portion 42) are guided into the corresponding recessed portions 431 through the notches 433. After bending at the notches 433, the wires 31 are guided into the recessed portions 431, so that they can be easily soldered onto the pins 432. In addition to easy soldering, the wires 31 are close enough to the bottom portion 43, such that there is no gap between them. This prevents the wires 31 from coming off during the manufacturing process or transportation. It also prevents the wires 31 from protruding out of the seat 4 and coming into contact and short-circuiting with the other electronic elements.

Moreover, the back plate 411 of the base 41 is provided with the insertion slot 4111. The depth of the insertion slot is at least equal to or slightly less than the height of the portion of the separating portion 44 that is protruding from the top portion 42 and the bottom portion 43. In such a way, a plurality of the present invention can be easily stacked together for assembly and/or transportation. Meanwhile, once the present invention is vertically provided on a circuit board, it does not occupy too much footprint on the circuit board as the areas of the top portion 42 and the bottom portion 43 are smallest (compared to the areas in other directions), such that the area of the circuit board can be effectively reduced. In addition, the back plate 411 of the base 41 are provided with hollow portions 410, which are in communication with the receiving slots 40, thus improving heat dissipation.

In view of this, the upright composite common mode coil assembly of present invention is submitted to be novel and non-obvious and a patent application is hereby filed in accordance with the patent law. It should be noted that the descriptions given above are merely descriptions of preferred embodiments of the present invention, various changes, modifications, variations or equivalents can be made to the invention without departing from the scope or spirit of the invention. It is intended that all such changes, modifications and variations fall within the scope of the following appended claims and their equivalents.

What is claimed is:

1. An upright composite common mode coil assembly comprising:

a coil carrier including two bobbins, a group of coils being wounded around the outer circumference of each of the bobbins; and a seat including:

a base having a back plate on a surface thereof, hollow portions formed at an upper position and a lower position of the back plate, a wire slot provided at either side of the back plate, and an indentation extending from one end of each of the wire slots;

a bottom portion extending vertically from a side of the base closer to the indentations, a recessed portion formed at each of the corners of the bottom portion, and a pin inserted into each of the recessed portions;

a top portion extending vertically from another side of the base and including a flat top face; and a separating portion extending from another surface of the base and being tapered to form a curved surface, and the separating portion forming a receiving slot with the top portion and another receiving slot with the bottom portion, wherein some of the recessed portions are in communication with the indentations, while the rest of the recessed portions respectively form notches with adjacent regions of the bottom portion;

wherein one bobbin of the coil carrier is received in each of the receiving slots of the seat, and wires of a group of the coils are guided into some of the recessed portions through the wire slots and the indentations, and wires of another group of the coils are guided into the other recessed portions through the notches, so that the wires of the coils do not protrude out of the seat and are neatly soldered on the pins; and wherein a wing portion extends from a side of each indentation, and a concaved portion is formed between each indentation and its corresponding wing portion.

2. The upright composite common mode coil assembly of claim 1, wherein the coil carrier includes two carrier plates connected through two columns, each of the bobbins includes two semi-bobbins, and the two semi-bobbins combine to surround a respective one of the two columns.

3. The upright composite common mode coil assembly of claim 2, wherein one bobbin of the coil carrier is received in each of the receiving slots of the seat, and the carrier plates are positioned between the top portion and the bottom portion of the seat.

4. The upright composite common mode coil assembly of claim 1, wherein a surface of the back plate of the base is provided with an insertion slot.

5. The upright composite common mode coil assembly of claim 1, wherein the wing portions of the indentations near the bottom portion overlie the surfaces of the wires, such that after the wires are passed into the recessed portions, the concaved portions facilitate neat soldering of the wires on the pins.

6. The upright composite common mode coil assembly of claim 1, wherein insertion holes for holding the pins in place are provided in the respective recessed portions.

* * * * *